US009250548B2

(12) United States Patent
Nomura et al.

(10) Patent No.: US 9,250,548 B2
(45) Date of Patent: Feb. 2, 2016

(54) TONER

(71) Applicant: CANON KABUSHIKI KAISHA, Tokyo (JP)

(72) Inventors: Shotaro Nomura, Suntou-gun (JP); Masami Fujimoto, Suntou-gun (JP); Katsuhisa Yamazaki, Numazu (JP); Koji Nishikawa, Susono (JP); Daisuke Yoshiba, Suntou-gun (JP); Hiroki Akiyama, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/339,689

(22) Filed: Jul. 24, 2014

(65) Prior Publication Data

US 2015/0037726 A1 Feb. 5, 2015

(30) Foreign Application Priority Data

Jul. 31, 2013 (JP) ..... 2013-158914

(51) Int. Cl.

| | |
|---|---|
| ***G03G 9/097*** | (2006.01) |
| ***G03G 9/083*** | (2006.01) |
| ***G03G 9/087*** | (2006.01) |
| ***G03G 9/08*** | (2006.01) |

(52) U.S. Cl.

CPC ..... *G03G 9/0838* (2013.01); *G03G 9/0815* (2013.01); *G03G 9/0819* (2013.01); *G03G 9/0821* (2013.01); *G03G 9/0827* (2013.01); *G03G 9/0837* (2013.01); *G03G 9/08782* (2013.01); *G03G 9/09716* (2013.01); *G03G 9/09725* (2013.01)

(58) Field of Classification Search

CPC ..... G03G 9/09716; G03G 9/09708; G03G 9/09725; G03G 9/08782

See application file for complete search history.

(56) References Cited

U.S. PATENT DOCUMENTS

| | | | |
|---|---|---|---|
| 5,302,483 | A | 4/1994 | Yamane et al. |
| 7,803,508 | B2 | 9/2010 | Ishii et al. |
| 2004/0058258 | A1 | 3/2004 | Yoshino et al. |
| 2006/0063085 | A1 | 3/2006 | Lee et al. |

FOREIGN PATENT DOCUMENTS

| | | | |
|---|---|---|---|
| JP | 2002-318467 | A | 10/2002 |
| JP | 2005-202131 | A | 7/2005 |
| JP | 2007-279702 | A | 10/2007 |
| JP | 4321272 | B2 | 8/2009 |
| WO | 2013/063291 | A1 | 5/2013 |

OTHER PUBLICATIONS

U.S. Appl. No. 14/446,286, filed Jul. 29, 2014. Inventor: Naka, et al.
U.S. Appl. No. 14/341,084, filed Jul. 25, 2014. Inventor: Nishikawa, et al.
European Search Report dated Jan. 20, 2015 in European Application No. 14179041.0.
Fedors, "A Method for Estimating Both the Solubility Parameters and Molar Volumes of Liquids", Polymer Engineering and Science, vol. 14, No. 2, 1974, pp. 147-154.

*Primary Examiner* — Janis L Dote
(74) *Attorney, Agent, or Firm* — Fitzpatrick, Cella, Harper and Scinto

(57) ABSTRACT

The toner comprises: toner particles each containing a binder resin and a releasing agent; and an organic-inorganic composite fine particle, wherein: the organic-inorganic composite fine particle comprises: a vinyl resin particle containing a vinyl resin, the vinyl resin containing THF-insoluble matter in an amount of 95% by mass or more; and inorganic fine particles which are exposed at surfaces of the respective organic-inorganic composite fine particles, the organic-inorganic composite fine particle 1) has a plurality of convexes derived from the inorganic fine particles on the surfaces thereof, 2) has a number average particle size of 70-500 nm, and 3) has a shape factor SF-2 as measured at a magnification of 200,000 times of 103-120, and an absolute value of difference between an SP value of the releasing agent and an SP value of the vinyl resin is 0.50 $(cal/cm^3)^{1/2}$ or less.

2 Claims, No Drawings

TONER

BACKGROUND OF THE INVENTION

1. Field of the Invention

The present invention relates to a toner used for electrophotography, electrostatic recording, magnetic recording and the like.

2. Description of the Related Art

In recent years, a higher energy saving effect and a longer life-span than before have been required for an electrophotographic apparatus. The units for achieving energy saving may include energy saving of the mechanical driving part of an electrophotographic apparatus and energy saving of an information processor. Especially, energy saving of a heat fixing apparatus is an effective unit. Specific units may include a reduction in the size of the members in the heat fixing apparatus and an improvement in heating efficiency, and a particularly effective unit is a reduction in the temperature during heat fixing.

In order to achieve the heat fixing at lower temperatures than before, toner particles tend to have a structure that is more easily softened by heat and is easily melted. However, when the softened toner particles are mechanically loaded, an external additive is easily embedded therein, and the longer life-span cannot be easily achieved. Consequently, many proposals of external additives having a large particle size that cannot be easily embedded in the toner surface have been made at present.

Japanese Patent Application Laid-Open Nos. 2002-318467 and 2007-279702 have proposed the use of silica particles as an external additive having a large particle size. Japanese Patent Application Laid-Open No. 2005-202131 and WO 2013/063291 have proposed the use of organic-inorganic composite fine particles as an external additive having a large particle size. However, these external additives do not show the effect of improvement of adhesion and accumulation of molten toner to a fixing unit member due to hot offset and occurrence of an image failure by the adhesion and accumulation thereof. The contamination of the fixing unit member by the molten toner that is hot offset is increasingly becoming a serious problem with the longer life-span of the electrophotographic apparatus, and a solution of the problem has been sought.

SUMMARY OF THE INVENTION

An object of the present inventions is to provide a toner which can solve the above problem. Specifically, an object of the present invention is to provide a toner which is excellent in low-temperature fixability, suppresses the occurrence of hot offset and the contamination of a fixing unit member even if many sheets are printed, and can obtain images having stable image density.

The present invention relates to a toner comprising: toner particles each containing a binder resin and a releasing agent; and an organic-inorganic composite fine particle, wherein: the organic-inorganic composite fine particle comprises: a vinyl resin particle containing a vinyl resin, the vinyl resin containing THF-insoluble matter in an amount of 95% by mass or more; and inorganic fine particles which are exposed at surfaces of the respective organic-inorganic composite fine particles, the organic-inorganic composite fine particle 1) has a plurality of convexes derived from the inorganic fine particles on the surfaces thereof, 2) has a number average particle size of 70 nm or more and 500 nm or less, and 3) has a shape factor SF-2 as measured at a magnification of 200,000 times of 103 or more and 120 or less; and wherein an absolute value of a difference between an SP value of the releasing agent and an SP value of the vinyl resin is 0.50 $(cal/cm^3)^{1/2}$ or less.

The present invention can provide a toner which is excellent in low-temperature fixability, suppresses the occurrence of hot offset and the contamination of a fixing unit member even if many sheets are printed, and can obtain images having stable image density.

Further features of the present invention will become apparent from the following description of exemplary embodiments.

DESCRIPTION OF THE EMBODIMENTS

Preferred embodiments of the present invention will now be described in detail.

Longer life-span can be achieved by adding an external additive having a large particle size even when toner matrix particles excellent in low-temperature fixability are used.

However, the contamination of a fixing unit member by molten toner that is hot offset has become serious with the longer life-span.

Thus, as a result of investigations by the present inventors, it has been found that the problem as described above can be solved even for the toner matrix particles excellent in low-temperature fixability by using organic-inorganic composite fine particles having controlled particle size and shape and in addition by controlling the absolute value of the difference between the SP value of the resin contained in the organic-inorganic composite fine particles and the SP value of the releasing agent contained in the toner matrix particles within a suitable range. The details will be described below.

First, the toner matrix particles excellent in low-temperature fixability have high followability to heat and are easily melted and softened. Therefore, it is deemed that the elasticity of resin during the heat fixing cannot be sufficiently ensured compared with conventional toner matrix particles, thus generating hot offset. However, since there is a premise of having low-temperature fixability, it is hard to take the measure of hardening and increasing elasticity of the toner resin.

Therefore, the present inventors have devised a technique of imparting hot offset resistance without preventing the softening of toner resin during the heat fixing. Generally, in order to improve hot offset, it is necessary to (1) ensure the elasticity of toner resin and to (2) coat the toner surface with a releasing agent to ensure releasing properties. The present inventors have devised a technique of achieving these conditions also for the toner matrix particles having low-temperature fixability.

The thickening effect generated when a fine rigid body is dispersed in a fluid has attracted attention at this time. This is an effect that, when a fine rigid body such as an external additive is dispersed in a fluid such as molten resin, friction occurs between rigid body particles and the fluid in contact with the rigid body particles to reduce flow velocity to thereby increase the viscosity and elasticity of the whole fluid. With this effect as a guide, the present inventors externally added organic-inorganic composite fine particles which exhibit a thickening effect in resin to the surface of toner matrix particles. It has been found, thereby, the toner surface layer is thickened by the embedded external additive particles, showing high elasticity and exhibiting hot offset resistance even in the state where the toner matrix particles are melted at a fixing unit temperature where hot offset occurs.

However, this embedded external additive will be an obstacle that blocks the route through which a releasing agent oozes out to a toner surface. Therefore, the present inventors have paid their attention to the compatibility between the organic material part of the organic-inorganic composite fine particles and the releasing agent in order not to disturb the oozing out of the releasing agent to the toner surface even if the external additive is embedded in the toner resin. Specifically, it has been found that quick oozing out of the releasing agent during heat fixing can be achieved and high hot offset resistance can be exhibited, by combining a releasing agent having an SP value that is close to the SP value of a vinyl resin of the organic-inorganic composite fine particles with the organic-inorganic composite fine particles. The SP value is an index of the polarity and compatibility of materials that is called a solubility parameter. When wetting is taken into consideration, it is known that materials having close SP values get wet quickly in a wide range.

The results of investigations by the present inventors have revealed that it is important that, as the shape of organic-inorganic composite fine particles for allowing a desired thickening effect to be exhibited while functioning as an external additive, the organic-inorganic composite fine particles have a structure where inorganic fine particles are embedded in the surface of vinyl resin particles. Moreover, the organic-inorganic composite fine particles need to have a plurality of convexes derived from the inorganic fine particles on the surface thereof. Note that the inorganic fine particles may be present on the surface of the organic-inorganic composite fine particles, and the presence or absence of the inorganic fine particles in the inner part of vinyl resin particles is not particularly limited.

Moreover, it has been found that, in order to allow the organic-inorganic composite fine particles to exhibit a desired thickening effect, it is important to control the shape, the size and the amount of THF-insoluble matter of the particles.

As an index of the shape of the organic-inorganic composite fine particles, the shape factor SF-2 measured using a magnified image of the organic-inorganic composite fine particles photographed at a magnification of 200,000 times using a scanning electron microscope needs to be 103 or more and 120 or less. The shape factor SF-2 is an index of the unevenness degree of a particle, and the shape of the particle is a perfect circle when the value is 100, and the degree of unevenness increases as the numerical value increases.

When the SF-2 is 103 or more, the amount of the contact interface between the organic-inorganic composite fine particles and surrounding molten resin will be sufficiently large, thereby increasing the friction to exhibit sufficient thickening effect. For example, in the case of the particles having almost no convexes on the surface thereof such as common resin particles and sol-gel silica particles, it is difficult to obtain a thickening effect. On the other hand, when the organic-inorganic composite particles have a shape factor SF-2 of more than 120, a thickening effect will be excessive, and the low-temperature fixability tends to be reduced.

Moreover, the number average particle size of the organic-inorganic composite fine particles is required to be 70 nm or more and 500 nm or less. When the number average particle size is more than 500 nm, the surface area will be relatively reduced. Therefore, the friction between a fluid and a rigid body cannot be sufficiently ensured, and a thickening effect cannot be sufficiently exhibited. When the number average particle size is less than 70 nm, the particle size itself will be too small. Therefore, even if the SF-2 is within the range as described above, the scale of the surface unevenness can be too small to sufficiently exhibit a thickening effect. Moreover, the organic-inorganic composite fine particles are easily excessively embedded in the soft toner matrix particles excellent in low-temperature fixability and cannot function as an external additive when used for a long period of time.

Moreover, the number average particle size of the organic-inorganic composite fine particles can be 80 nm or more and 120 nm or less because such organic-inorganic composite fine particles impart sufficient flowability to a toner as an external additive and can sufficiently maintain a function as an external additive without being embedded even when used for a long period of time.

The amount of THF-insoluble matter of the vinyl resin constituting the vinyl resin particles contained in the organic-inorganic composite fine particles needs to be 95% by mass or more. This is because, in order for the organic-inorganic composite fine particles to exhibit a thickening effect in the toner surface-layer resin during the heat fixing, the particles need to maintain the shape even in a fixing unit temperature range where hot offset occurs. Moreover, when the amount of the THF-insoluble matter in the resin of the organic-inorganic composite fine particles is 95% by mass or more, the resin has elasticity to improve the elasticity of the toner surface layer, thereby increasing the hot offset resistance. Moreover, when the amount of the THF-insoluble matter in the resin of the organic-inorganic composite fine particles is less than 95% by mass, the organic-inorganic composite fine particles can be melted and cannot maintain the shape thereof in the fixing unit temperature range where hot offset occurs, and cannot sufficiently exhibit a thickening effect in the toner surface-layer resin to thereby reduce the hot offset resistance.

It is preferred that the organic-inorganic composite fine particles do not have an exothermic peak, an endothermic peak, and a glass transition point (Tg) in the range from 20° C. to 220° C. in the measurement of differential scanning calorimetry (DSC). This shows that when hot offset occurs, the surface temperature of a toner will increase to about 200° C., but when the above requirement is satisfied, the resin in the organic-inorganic composite fine particles will not be easily deformed at least until a temperature of 220° C. is reached.

Moreover, the absolute value of the difference between the SP value of the vinyl resin constituting the vinyl resin particles contained in the organic-inorganic composite fine particles and the SP value of a releasing agent needs to be 0.50 $(cal/cm^3)^{1/2}$ or less. When the absolute value of the difference of the SP values is 0.50 $(cal/cm^3)^{1/2}$ or less, the vinyl resin part of the organic-inorganic composite fine particles present on the toner matrix particle surface during the heat fixing is quickly covered with a dissolved releasing agent. Therefore, high hot offset resistance can be exhibited. If the absolute value of the difference between the SP values is larger than 0.50 $(cal/cm^3)^{1/2}$, the coating of the vinyl resin part of the organic-inorganic composite fine particles by a releasing agent will be insufficient, and the hot offset resistance can be reduced.

The SP values can be calculated by the Fedors method. Specifically, the method is described in detail in Polymer Engineering and Science, vol. 14, pp. 147 to 154 and the like, and the SP value can be calculated by the following formula.

$$SP\ \text{value} = \sqrt{(Ev/v)} = \sqrt{(\Sigma\Delta ei/\Sigma\Delta vi)} \qquad \text{Formula}$$

(wherein, Ev: evaporation energy (cal/mol), v: molar volume (cm/mol), Δei: evaporation energy of each atom or atomic group, Δvi: molar volume of each atom or atomic group)

As an index of the shape of the organic-inorganic composite fine particles according to the present invention, the shape factor SF-1 measured using a magnified image of the organic-inorganic composite fine particles photographed at a magnification of 200,000 times using a scanning electron microscope can be 110 or more and 140 or less because a surface layer thickening effect is exhibited more significantly. The shape factor SF-1 is an index of the roundness of a particle, which indicates that the shape of the particle is a perfect circle when the value is 100 and departs from a circle to an indefinite form as the numerical value increases. The organic-inorganic composite fine particles can sufficiently exhibit a thickening effect while maintaining the function as an external additive when the SF-1 is within the range as described above.

The inorganic fine particles of the organic-inorganic composite fine particles of the present invention can be silica or metal oxide fine particles. The silica or metal oxide fine particles are excellent in electrostatic properties, can impart sufficient flow performance to a toner and can satisfactorily function as an external additive.

The structure of the organic-inorganic composite fine particles will be shown below.

The organic-inorganic composite fine particles can be manufactured, for example, according to the description of Examples in WO 2013/063291.

The number average particle size, SF-1 and SF-2 of the organic-inorganic composite fine particles can be suitably controlled by changing the particle size of the inorganic fine particles used for the organic-inorganic composite fine particles and the quantitative ratio of the inorganic fine particles to the resin.

The amount of the organic-inorganic composite fine particles of the present invention added to the toner matrix particles can be suitably adjusted depending on the degree of a thickening effect. The amount can be 0.1 parts by mass or more and 4.0 parts by mass or less based on 100 parts by mass of the toner matrix particles.

The binder resin used for the toner matrix particles will be described.

Examples of the binder resin include a polyester resin, a vinyl resin, an epoxy resin and a polyurethane resin. In the present invention, the binder resin can be a hybrid resin in which the vinyl resin and the polyester resin are partly reacted among the above resins.

A vinyl polymer has an SP value close to that of the vinyl resin contained in the organic-inorganic composite fine particles. Therefore, the embedding of the organic-inorganic composite fine particles is accelerated during the heat fixing, and a high thickening effect is exhibited. Moreover, the difference of the SP values between the polyester polymer and a releasing agent is large. Consequently, the polyester polymer and the releasing agent are hardly compatible with each other in a toner, thereby accelerating the formation of a releasing agent domain. Therefore, the releasing agent which is present in the state of having formed the domain will quickly ooze out during the heat fixing.

The binder resin can have a structure in which a long-chain alkyl group is bonded to a part of polymer chains. When a long-chain alkyl group having a structure similar to the releasing agent is present in the polymer, the micro-dispersion of the releasing agent in the resin can be accelerated to achieve quick and uniform oozing out during the heat fixing. Moreover, when a long-chain alkyl group having an SP value close to that of the vinyl resin is present, the embedding of the organic-inorganic composite fine particles can be accelerated during the heat fixing, and a high thickening effect can be exhibited.

As a unit for allowing such a moiety to be present, a long-chain fatty acid or a long-chain alcohol (hereinafter, these two are generically referred to as "long-chain monomer") can be bonded to a terminal of the polyester part of the binder resin. By incorporating the long-chain monomer in a polyester terminal, the moiety where the long-chain monomer is present can be easily controlled, and a melting moiety can be uniformly incorporated into the polyester part.

It is preferred to bond a long-chain monomer having 20 or more and 100 or less carbon atoms, more preferably a long-chain monomer having 30 or more and 80 or less carbon atoms to a polyester resin terminal.

Specific examples of the long-chain fatty acid include saturated fatty acids such as stearic acid, arachidic acid, cerotic acid, heptacosanoic acid, montanic acid, melissic acid, lacceric acid, tetracontanoic acid and pentacontanoic acid; and unsaturated fatty acids such as oleic acid, linoleic acid and linolenic acid. Examples of the long-chain alcohol include saturated alcohols such as octadecyl alcohol, behenyl alcohol, ceryl alcohol, melissyl alcohol, tetracontanol and pentacontanol; and unsaturated alcohols such as oleyl alcohol and linoleyl alcohol.

The alcohol components and the acid components which can be used for synthesizing the polyester resin component in the hybrid resin are as follows.

Examples of the alcohol components include the following: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol and hydrogenated bisphenol A. Examples of aromatic diols include a bisphenol represented by the following formula (2) and a derivative thereof and diols represented by the following formula (3).

Formula (2)

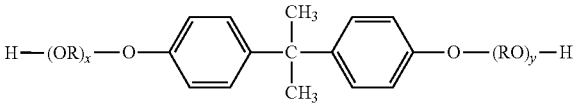

(wherein, R represents an ethylene or a propylene group; x and y are each an integer of 1 or more; and the average value of (x + y) is 2 to 10.)

Formula (3)

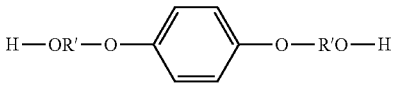

(wherein R′ represents

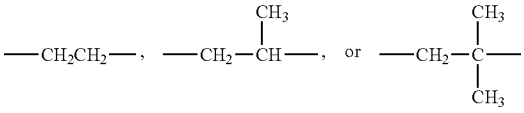

)

Examples of the acid components include the following: benzene dicarboxylic acids such as phthalic acid, terephthalic acid and isophthalic acid and anhydrides thereof such as phthalic anhydride; alkyl dicarboxylic acids such as succinic acid, adipic acid, sebacic acid and azelaic acid and anhydrides thereof; succinic acid substituted with an alkyl or an alkenyl group having 6 or more and 18 or less carbon atoms and anhydrides thereof; and unsaturated dicarboxylic acids such as fumaric acid, maleic acid, citraconic acid and itaconic acid and anhydrides thereof.

Examples of trihydric or higher polyhydric alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

Examples of trivalent or higher polyvalent carboxylic acid components include trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylene carboxypropane, tetra(methylenecarboxyl)methane, 1,2,7,8-octanetetracarboxylic acid, Empol trimer acid and anhydrides thereof.

The polyester resin is obtained by condensation polymerization.

On the other hand, examples of vinyl monomers for producing a vinyl resin component in the hybrid resin include the following.

Styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate, and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide.

Further examples include the following: unsaturated dibasic acids such as maleic acid, citraconic acid, itaconic acid, alkenylsuccinic acid, fumaric acid and mesaconic acid; unsaturated dibasic acid anhydrides such as maleic acid anhydride, citraconic anhydride, itaconic anhydride and alkenylsuccinic acid anhydride; half esters of unsaturated dibasic acids such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenyl succinic acid methyl half ester, fumaric acid methyl half ester and mesaconic acid methyl half ester; unsaturated dibasic acid esters such as dimethylmaleic acid ester and dimethylfumaric acid ester; α,β-unsaturated acids such as acrylic acid, methacrylic acid, crotonic acid and cinnamic acid; α,β-unsaturated acid anhydrides such as crotonic anhydride and cinnamic anhydride, and anhydrides between the α,β-unsaturated acid and lower fatty acids; and monomers each having a carboxyl group such as alkenylmalonic acid, alkenylglutaric acid, and alkenyladipic acid, acid anhydrides thereof and monoesters thereof.

Further examples include acrylates and methacrylates such as 2-hydroxyethyl acrylate, 2-hydroxyethyl methacrylate and 2-hydroxypropyl methacrylate; and monomers having a hydroxy group such as 4-(1-hydroxy-1-methylbutyl)styrene and 4-(1-hydroxy-1-methylhexyl)styrene.

In the toner of the present invention, the vinyl resin or vinyl polymer unit may have a crosslinking structure crosslinked with a crosslinking agent having two or more vinyl groups. Examples of the crosslinking agent used in this case include the following: aromatic divinyl compounds (divinylbenzene and divinylnaphthalene); diacrylate compounds bonded with an alkyl chain (ethylene glycol diacrylate, 1,3-butylene glycol diacrylate, 1,4-butanediol diacrylate, 1,5-pentanediol acrylate, 1,6-hexanediol diacrylate, neopentyl glycol diacrylate, and compounds obtained by replacing "acrylate" of the above compounds with "methacrylate"); diacrylate compounds bonded with an alkyl chain containing an ether bond (for example, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and compounds obtained by replacing "acrylate" of the above compounds with "methacrylate"); diacrylate compounds bonded with a chain containing an aromatic group and an ether bond [polyoxyethylene(2)-2,2-bis(4-hydroxyphenyl)propane diacrylate, polyoxyethylene(4)-2,2-bis(4-hydroxyphenyl)propane diacrylate, and compounds obtained by replacing "acrylate" of the above compounds with "methacrylate"]; and polyester diacrylate compounds ("MANDA" manufactured by Nippon Kayaku Co., Ltd.).

Examples of polyfunctional crosslinking agents include the following: pentaerythritol triacrylate, trimethylolethane triacrylate, trimethylolpropane triacrylate, tetramethylolmethane tetraacrylate, oligoester acrylate, and compounds obtained by replacing "acrylate" of the above compounds with "methacrylate"; and triallyl cyanurate and triallyl trimellitate.

These crosslinking agents can be used in an amount of preferably 0.01 parts by mass or more and 10.00 parts by mass or less, more preferably 0.03 parts by mass or more and 5.00 parts by mass or less based on 100 parts by mass of other monomer components.

Among these crosslinking agents, examples of crosslinking agents suitably used in the resin components in terms of low-temperature fixability and offset resistance include aromatic divinyl compounds (particularly divinylbenzene) and diacrylate compounds bonded with a chain containing an aromatic group and an ether bond.

Examples of polymerization initiators used for polymerization of the vinyl resin or vinyl polymer unit include the following: 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)isobutyronitrile, 2,2'-azobis(2,4,4-trimethylpentane), 2-phenylazo-2,4-dimethyl-4-methoxyvaleronitrile and 2,2'-azobis(2-methylpropane); ketone peroxides such as methyl ethyl ketone peroxide, acetylacetone peroxide, and cyclohexanone peroxide; and 2,2-bis(tert-butylperoxy)butane, tert-butyl hydroperoxide, cumene hydroperoxide, 1,1,3,3-tetramethylbutyl hydroperoxide, di-tert-butyl peroxide, tert-butylcumyl peroxide, dicumyl peroxide, α,α'-bis(tert-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-toluoyl peroxide, diisopropyl peroxydicarbonate, di-2-ethylhexyl peroxydicarbonate, di-n-propyl peroxydicarbonate, di-2-ethoxyethyl peroxydicarbonate, dimethoxyisopropyl peroxydicarbonate, di(3-methyl-3-methoxybutyl)peroxycarbonate, acetylcyclohexylsulfonyl peroxide, tert-butyl peroxyacetate, tert-butyl peroxyisobutyrate, tert-butyl peroxyneodecanoate, tert-butyl peroxy-2-ethylhexanoate, tert-butyl peroxylaurate, tert-butyl peroxybenzoate, tert-butyl peroxyisopropyl carbonate, di-tert-butyl peroxyisophthalate, tert-butyl peroxyallylcarbonate, tert-amyl peroxy-2-ethylhexanoate, di-tert-butyl peroxyhexahydroterephthalate and di-tert-butyl peroxyazelate.

When a hybrid resin is used in the present invention, a vinyl resin and/or a polyester resin component can contain a monomer component which can react with both of these resin components. Examples of monomers that can react with the vinyl resin among the monomers constituting the polyester resin component include unsaturated dicarboxylic acids such as fumaric acid, maleic acid, citraconic acid and itaconic acid and anhydrides thereof. Examples of monomers that can react with the polyester resin component among the monomers constituting the vinyl resin component include monomers each having a carboxyl group or a hydroxy group; and acrylates and methacrylates.

A method for obtaining a reaction product of the vinyl resin and the polyester resin can be a method in which the reaction product is obtained, in the presence of a polymer containing a monomer component which can react with each of the above-described vinyl resin and polyester resin, by causing a polymerization reaction with either one or both of the resins.

The releasing agent used in the present invention can be a releasing agent having a melting point, which is the endothermic peak temperature measured by DSC, of 85 to 120° C.

Examples of the releasing agents used in the present invention include the following: aliphatic hydrocarbon waxes such as a polyolefin copolymer, a polyolefin wax, a microcrystalline wax, a paraffin wax, and a Fischer-Tropsch wax. A releasing agent having a sharper molecular weight distribution than the above releasing agents can also be used, the releasing agent being obtained through a press sweating process, a solvent method, a recrystallization method, a vacuum distillation method, a supercritical gas extraction method or a melt crystallization method.

Specific examples of the releasing agents include Sasol H1, H2, C80, C105 and C77 (Schumann Sasol GmbH); HNP-1, HNP-3, HNP-9, HNP-10, HNP-11 and HNP-12 (NIPPON SEIRO CO., LTD.); UNILIN(R) 350, 425, 550 and 700 and UNICID(R), UNICID(R) 350, 425, 550 and 700 (Toyo Petrolite Co., Ltd.).

The toner of the present invention may contain a magnetic material. Note that the magnetic material generally acts also as a coloring agent.

Examples of the magnetic material contained in the toner in the present invention include iron oxides such as magnetite, hematite and ferrite; metals such as iron, cobalt and nickel; alloys of these metals with metals such as aluminum, cobalt, copper, lead, magnesium, tin, zinc, antimony, bismuth, calcium, manganese, titanium, tungsten and vanadium; and mixtures thereof.

These magnetic materials preferably has a number average particle size of 0.05 μm or more and 2.0 μm or less, more preferably 0.10 μm or more and 0.50 μm or less. The amount of these magnetic materials contained in the toner is preferably 30 parts by mass or more and 120 parts by mass or less based on 100 parts by mass of a binder resin, particularly preferably 40 parts by mass or more and 110 parts by mass or less based on 100 parts by mass of a binder resin.

With respect to the coloring agents used in the present invention, carbon black, grafted carbon, and a black color obtained from yellow/magenta/cyan coloring agents to be described below can be used as a black coloring agent.

Examples of yellow coloring agents include compounds such as a condensed azo compound, an isoindolinone compound, an anthraquinone compound, an azo-metal complex, a methine compound and an arylamide compound.

Examples of magenta coloring agents include a condensed azo compound, a diketo pyrrolo pyrrole compound, anthraquinone, a quinacridone compound, a base dye lake compound, a naphthol compound, a benzimidazolone compound, a thioindigo compound and a perylene compound.

Examples of cyan coloring agents include a copper phthalocyanine compound and a derivative thereof, an anthraquinone compound and a base dye lake compound. These coloring agents can be used singly or in combination, and can also be used in the state of a solid solution.

The coloring agent of the present invention is selected in terms of a hue angle, chroma, lightness, weatherability, OHP transparency and dispersibility in toner. The additive amount of the coloring agent is 1 part by mass or more and 20 parts by mass or less based on 100 parts by mass of a resin.

The toner of the present invention may contain a crystalline resin.

Examples of the crystalline resin include a crystalline polyester. At least an aliphatic diol having 4 or more and 20 or less carbon atoms and a polyvalent carboxylic acid can be used as the raw materials for the crystalline polyester.

Moreover, the aliphatic diol can be linear. When the aliphatic diol is linear, the crystallinity of the resin can be easily increased.

Examples of the aliphatic diols that can be used for the synthesis of the crystalline polyester include, but are not limited to, the following: 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-eicosanediol. Note that these diols can also be used in combination.

Aliphatic diols having a double bond can also be used. Examples of the aliphatic diols having a double bond include the following: 2-butene-1,4-diol, 3-hexene-1,6-diol and 4-octene-1,8-diol.

Examples of polyvalent carboxylic acids which can be used for the synthesis of the crystalline polyester can include aromatic dicarboxylic acids and aliphatic dicarboxylic acids. Among them, aliphatic dicarboxylic acids are preferred, and linear dicarboxylic acids are particularly preferred in terms of crystallinity.

Examples of the aliphatic dicarboxylic acids include, but are not limited to, the following: oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid and 1,18-octadecanedicarboxylic acid. Note that these dicarboxylic acids can also be used in combination. Further examples include lower alkyl esters and acid anhydrides thereof. Among these, sebacic acid, adipic acid, 1,10-decanedicarboxylic acid or lower alkyl esters and acid anhydrides thereof are preferred.

Examples of the aromatic dicarboxylic acids include the following: terephthalic acid, isophthalic acid, 2,6-naphthalenedicarboxylic acid and 4,4'-biphenyldicarboxylic acid. Among these, terephthalic acid is preferred in terms of availability and ease in forming a low-melting point polymer.

Dicarboxylic acids having a double bond can also be used. Examples of such dicarboxylic acids include fumaric acid, maleic acid, 3-hexenedioic acid and 3-octenedioic acid. Further examples include lower alkyl esters and acid anhydrides thereof. Among these, fumaric acid and maleic acid are preferred in terms of cost.

A method for producing the crystalline polyester is not particularly limited, but the crystalline polyester can be produced by a common polyester polymerization method in which an acid component and an alcohol component are allowed to react with each other. For example, the crystalline polyester may be produced by properly using direct polycondensation or an ester interchange method depending on the type of monomer.

The crystalline polyester can be produced at a polymerization temperature of 180° C. or more and 230° C. or less, and the reaction can be performed while removing water and alcohol generated during condensation with the pressure in the reaction system being optionally reduced. When monomers are not soluble or compatible under the reaction temperature, a high-boiling solvent may be added as a solubilizing agent to dissolve the monomers. The polycondensation reaction is performed while distilling off the solvent for solubilization. When a monomer with low compatibility is present in the copolymerization reaction, the monomer with low compatibility can be previously condensed with an acid or an alcohol to be subjected to polycondensation with the monomer and then subjected to polycondensation together with the main component.

Examples of the catalyst that can be used for the production of the crystalline polyester include the following: titanium catalysts such as titanium tetraethoxide, titanium tetrapropoxide, titanium tetraisopropoxide and titanium tetrabutoxide; and tin catalysts such as dibutyltin dichloride, dibutyltin oxide and diphenyltin oxide.

In order to stabilize the electrostatic properties of the toner of the present invention, a charge control agent can be used in the toner. An organometallic complex and a chelate compound are effective as the charge control agent, and examples thereof include a monoazo metal complex; an acetylacetone metal complex; and a metal complex or a metal salt of an aromatic hydroxycarboxylic acid or an aromatic dicarboxylic acid.

Specific examples of the charge control agent include Spilon Black TRH, T-77 and T-95 (Hodogaya Chemical Co., Ltd.) and BONTRON(R) S-34, S-44, S-54, E-84, E-88 and E-89 (Orient Chemical industries Co., Ltd.). Moreover, a charge control resin may be used singly or in combination with the above-described charge control agent.

The method for producing the toner matrix particles according to the present invention is not particularly limited, and for example, known production methods such as a pulverization method, a suspension polymerization method, a dissolution suspension method, an emulsion aggregation method and a dispersion polymerization method can be used. In particular, the pulverization method is preferred because this method provides high uniformity of material dispersion and is advantageous in terms of oozing out of a releasing agent.

In the pulverization method, toner matrix particles can be obtained by i) mixing a binder resin, a releasing agent and other additives in a mixer such as a Henschel mixer and a ball mill;

ii) melt-kneading the resulting mixture using a heat kneading machine such as a twin-screw kneading extruder, a heating roller, a kneader and an extruder;

iii) solidifying the melt-kneaded product by cooling followed by pulverization; and iv) classifying the resulting fine pulverized product.

The pulverization method can further include surface treatment after the pulverization or classification for controlling the shape and surface properties of the toner matrix particles.

Examples of the mixer include the following: Henschel Mixer (manufactured by Mitsui Mining Co., Ltd.); Super Mixer (manufactured by Kawata Mfg. Co, Ltd.); Ribocone (manufactured by Okawara Mfg. Co., Ltd.); Nauta Mixer, Turbulizer, Cyclomix (manufactured by Hosokawa Micron Corp.); Spiral Pin Mixer (manufactured by Pacific Machinery & Engineering Co., Ltd.); and Loedige Mixer (manufactured by Matsubo Corporation).

Examples of the kneading machine include the following: KRC Kneader (manufactured by Kurimoto, Ltd.); Buss Co-kneader (manufactured by Buss AG); TEM-type Extruder (manufactured by Toshiba Machine Co., Ltd.); TEX twin-screw extruder (manufactured by Japan Steel Works, Ltd.); PCM extruder (manufactured by Ikegai Iron Works Co., Ltd.); Triple roll mill, Mixing roll mill and Kneader (manufactured by Inoue Mfg., Inc.); Kneadex (manufactured by Mitsui Mining Co., Ltd.); MS-type pressurized kneader and Kneader Ruder (manufactured by Moriyama Mfg. Works, Ltd.); and Banbury mixer (manufactured by Kobe Steel, Ltd.).

Examples of the pulverizing machine include the following: Counter Jet Mill, Micron Jet and Inomizer (manufactured by Hosokawa Micron Corp.); IDS-type Mill and PJM Jet Mill (manufactured by Nippon Pneumatic Mfg. Co., Ltd.); Cross Jet Mill (Manufactured by Kurimoto, Ltd.); Ulmax (manufactured by Nisso Engineering Co., Ltd.); SK Jet-O-Mill (manufactured by Seishin Enterprise Co., Ltd.); Kriptron (manufactured by Kawasaki Heavy Industries, Ltd.); Turbo Mill (manufactured by Turbo Kogyo Co., Ltd.); and Super Rotor (manufactured by Nisshin Engineering Inc.).

Examples of the classifier include the following: Classiel, Micron Classifier and Spedic Classifier (manufactured by Seishin Enterprise Co., Ltd.); Turbo Classifier (manufactured by Nisshin Engineering Inc.); Micron Separator, Turboplex (ATP) and TSP Separator (manufactured by Hosokawa Micron Corp.); Elbow-Jet (manufactured by Nittetsu Mining Co., Ltd.); Dispersion Separator (manufactured by Nippon Pneumatic Mfg. Co., Ltd.); and YM Microcut (manufactured by Yasukawa Shoji K.K.).

Examples of the surface modification apparatus include Faculty (manufactured by Hosokawa Micron Corp.), Mechanofusion (manufactured by Hosokawa Micron Corp.), Nobilta (manufactured by Hosokawa Micron Corp), Hybridizer (manufactured by Nara Machinery Co., Ltd.), Inomizer (manufactured by Hosokawa Micron Corp.), Theta Composer (manufactured by Tokuju Corporation) and Mechanomill (manufactured by Okada Seiko Co., Ltd.).

Examples of the sieving apparatus used for sieving coarse particles include the following: Ultra Sonic (manufactured by Koei Sangyo Co., Ltd.); Resona Sieve and Gyro Shifter (manufactured by Tokuju Corporation); Vibrasonic System (manufactured by Dalton Corporation); Soniclean (manufactured by Shinto Kogyo K.K.); Turbo Screener (manufactured by Turbo Kogyo Co., Ltd.); Micro Sifter (manufactured by Makino Mfg. Co., Ltd.); and a circular vibrating sieve.

The toner of the present invention can contain an external additive other than the organic-inorganic composite fine particles. Particularly, in order to improve the flowability and electrostatic properties of toner, a flow improver having a small particle size (the number average particle size of primary particles being about 5 to 30 nm) can be added as other external additives.

Examples of the flow improver include: fluororesin powder such as vinylidene fluoride fine powder and polytetrafluoroethylene fine powder; fine powder silicas such as wet-process silica and dry-process silica, fine powder titanium oxide, fine powder alumina and treated silicas prepared by surface-treating the fine powder silica with a silane compound, a titanium coupling agent or silicone oil; oxides such as zinc oxide and tin oxide; complex oxides such as strontium titanate, barium titanate, calcium titanate, strontium zirconate and calcium zirconate; and carbonate compounds such as calcium carbonate and magnesium carbonate.

A preferred flow improver is a fine powder produced by the vapor-phase oxidation of silicon halide, which is so-called dry-process silica or fumed silica. For example, a thermal decomposition oxidation reaction in the oxyhydrogen flame of silicon tetrachloride gas is utilized, and the basic reaction formula is as follows.

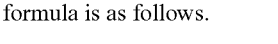

$$SiCl_4+2H_2+O_2 \rightarrow SiO_2+4HCl$$

It is also possible to obtain a composite fine powder of silica and other metal oxides in this production step by using other metal halides such as aluminum chloride or titanium chloride with silicon halide, and these composite fine powders are also included in silica.

Examples of commercially available silica fine powder produced by the vapor-phase oxidation of silicon halide include the following: AEROSIL (Nippon Aerosil Co., Ltd.) 130, 200, 300, 380, TT600, MOX170, MOX80 and COK84, Ca-O-SiL (CABOT Co., Ltd.) M-5, MS-7, MS-75, HS-5 and EH-5, Wacker HDK N 20 (WACKER-CHEMIE GMBH) V15, N20E, T30 and T40, D-C Fine Silica (Dow Corning Corp.) and Fransol (Fransil Co., Ltd.).

In addition, a treated silica fine powder prepared by hydrophobic treatment of a silica fine powder produced by the vapor phase oxidation of the silicon halide is more preferred as a flow improver to be used in the present invention.

The flow improver can have a specific surface area determined by nitrogen adsorption measured by a BET adsorption method of 30 $m^2/g$ or more and 300 $m^2/g$ or less.

The total additive amount of the flow improver is preferably 0.01 parts by mass or more and 8 parts by mass or less, more preferably 0.1 parts by mass or more and 4 parts by mass or less based on 100 parts by mass of the toner matrix particles.

Next, the measuring methods of physical properties according to the present invention will be described.

<Measuring Methods of Exothermic Peak, Endothermic Peak and Tg of Organic-Inorganic Composite Fine Particles/Binder Resin> S The maximum value, the minimum value and the endothermic quantity of a DSC curve of a binder resin in the present invention are measured according to ASTM D3418-using a differential scanning calorimetry apparatus "Q1000" (manufactured by TA Instruments Inc.).

The melting points of indium and zinc are used for the temperature correction of the apparatus detecting element, and the heat of fusion of indium is used for the correction of the quantity of heat.

Specifically, about 5 mg of a sample is precisely weighed and placed in an aluminum pan. This sample is subjected to measurement at a heating rate of 10° C./min in a measurement temperature range of 20 to 220° C. using an empty aluminum pan as a reference. Note that in the measurement, the temperature is once increased to 220° C. and then decreased to 20° C. at a cooling rate of 10° C./min, and then the temperature is increased again. The physical properties specified in the present invention are determined from the endothermic peak of the DSC curve in a temperature range of 20 to 220° C. in this second heating process. The change of specific heat is obtained in this heating process. At this time, the point of intersection of the line at the midpoint of the baselines before and after the change of specific heat appears and the differential thermal curve is defined as the glass transition temperature Tg of a binder resin.

The exothermic peak obtained after the glass transition temperature Tg in a temperature range of 20° C. or more and 220° C. or less in this heating process is defined as the maximum value, and the endothermic peak obtained by further increasing the temperature is defined as the minimum value. On the other hand, the endothermic quantity ΔH of these exothermic peak and endothermic peak can be obtained by determining the integrated values of the above exothermic peak and endothermic peak.

When organic-inorganic composite fine particles are measured, the organic-inorganic composite fine particles were isolated from the toner matrix particle as follows. First, the toner is ultrasonically dispersed in ion-exchanged water to which several drops of "Contaminon N" (10% by mass aqueous solution of a neutral detergent for cleaning a precision measuring equipment which includes a nonionic surfactant, an anionic surfactant, and an organic builder and has a pH of 7, manufactured by Wako Pure Chemical Industries, Ltd.) were added, and the resulting dispersion are allowed to stand still for 24 hours. An external additive can be isolated by collecting supernatant liquid followed by drying. When a plurality of external additives are externally added to the toner, the organic-inorganic composite fine particles can be isolated by centrifuging the supernatant liquid.

<Measuring Method of the Number Average Particle Size of External Additives (Organic-Inorganic Composite Fine Particles)>

The measurement of the number average particle size of primary particles of external additives is performed using a scanning electron microscope "S-4800" (trade name; manufactured by Hitachi Ltd.). The toner to which an external additive is externally added is observed, and the major axes of the primary particles of 100 external additives are measured at random in a visual field magnified by a maximum of 200,000 times to determine the number average particle size. The magnification of observation is suitably adjusted depending on the size of external additives.

<Measuring Method of Shape Factors SF-1 and SF-2 of Organic-Inorganic Composite Fine Particle>

The toner to which organic-inorganic composite fine particles are externally added is observed using a scanning electron microscope (SEM) "S-4800" (manufactured by Hitachi Ltd.).

In a visual field magnified by 200,000 times, image processing software "Image-Pro Plus 5.1J" (manufactured by Media Cybernetics, Inc.) was used to calculate the circumferences and areas of the primary particles of 100 organic-inorganic composite fine particles.

The SF-1 and SF-2 of each organic-inorganic composite fine particle were calculated by the following expressions, and the average values for 100 particles were defined as the SF-1 and SF-2 to be specified in the present invention.

$$SF\text{-}1=(\text{maximum length of particle})^2/\text{area of particle}\times\pi/4\times100$$

$$SF\text{-}2=(\text{maximum length of particle})^2/\text{area of particle}\times100/4\pi$$

<Measuring Method of THF-Insoluble Matter in Resin of Organic-Inorganic Composite Fine Particles>

The THF-insoluble matter in the resin of the organic-inorganic composite fine particles was quantitatively determined as follows.

About 0.1 g of organic-inorganic composite fine particles is precisely weighed (Wc [g]) and placed in a previously weighed centrifugal separation bottle (for example, trade name "Oak Ridge Centrifugation Tube 3119-0050" (size: 28.8×106.7 mm), manufactured by Nalgene Nunc International). Thereto, 20 g of THF is added, and the resulting mixture is allowed to stand at room temperature for 24 hours to extract THF-soluble matter. Next, this centrifugal separation bottle was set to a centrifuge "himac CR22G" (manufactured by Hitachi Koki Co., Ltd.) and centrifuged at 15,000 rpm for 1 hour at a set temperature of 20° C. to thereby completely precipitate the THF-insoluble matter of the whole organic-inorganic composite fine particles. The centrifugal separation bottle was taken out, and the extract of the THF-soluble matter was separated and removed. Then, the centrifugal separation bottle containing the content therein was vacuum dried at 40° C. for 8 hours. The resulting centrifugal separation bottle was weighed, and the previously weighed mass of the centrifugal separation bottle was subtracted from the mass of the resulting centrifugal separation bottle containing the content to thereby determine the mass (Wr [g]) of the THF-insoluble matter in the whole organic-inorganic composite fine particles.

The THF-insoluble matter [% by mass] in the resin of the organic-inorganic composite fine particles was calculated by the following formula in which the content of inorganic fine particles in the organic-inorganic composite fine particles was defined as Wi [% by mass].

THF-insoluble matter in the resin of the organic-inorganic composite fine particles [% by mass]= $\{(Wr-We\times Wi/100)/Wc\times(100-Wi)/100\}\times 100$ Note that the content Wi [% by mass] of the inorganic fine particles in the organic-inorganic composite fine particles is measured as follows. A thermogravimetric analyzer (TGA) "Q50001R type" (manufactured by TA Instruments Inc.) is used for the measurement.

About 0.03 g of organic-inorganic composite fine particles is placed in a pan dedicated to the "Q50001R type" as a sample, and the pan is set to the analyzer. At this time, the sample quantity is suitably adjusted in consideration of the bulkiness of the organic-inorganic composite fine particles. The sample is brought into a condition of equilibrium at 50° C. under normal pressure and kept in equilibrium for 10 minutes, and then sample mass (A) is measured. Subsequently, the sample is supplied with nitrogen gas and heated to a temperature of 900° C. at a heating rate of 20° C./min in a nitrogen atmosphere under normal pressure, and then sample mass (B) is measured.

The Wi [% by mass] refers to the mass (B) of the sample after being heated to 900° C. relative to the mass (A) of the sample after being held at 50° C. for 10 minutes, and was determined by following formula.

$Wi$ [% by mass]$=(B/A)\times 100$

<Measuring Method of THF-Insoluble Matter of Resin in Organic Particles>

The THF-insoluble matter in the resin of the organic particles was determined in same manner as in the measuring method of the THF-insoluble matter in the resin of the organic-inorganic composite fine particles. However, since organic particles do not contain inorganic fine particles, the calculation is performed by defining Wi as 0.

EXAMPLES

The present invention will be described in more detail below with reference to Examples and Comparative Examples, but the present invention is not at all limited to these examples. Note that all the "parts" in Examples and Comparative Examples are based on mass unless otherwise specified.

<Production Example of Hybrid Resin 1>

| | |
|---|---|
| Bisphenol A-ethylene oxide adduct (2.2 mol addition) | 100.0 parts |
| Terephthalic acid | 60.0 parts |
| Trimellitic anhydride | 20.0 parts |
| Acrylic acid | 10.0 parts |

A secondary monoalcohol (long-chain monomer) in which one hydrogen atom of a linear saturated hydrocarbon having 70 carbon atoms was substituted by a hydroxy group was added to the above polyester monomers so that the amount of the secondary monoalcohol might be 5.0 parts by mass based on 100 parts by mass of a resin to be obtained. Sixty parts of the resulting mixture is charged into a four-necked flask, which is equipped with a pressure decreasing apparatus, a water separation apparatus, a nitrogen gas introducing apparatus, a temperature measuring apparatus and a stirring apparatus, and then the mixture is stirred at 160° C. in a nitrogen atmosphere. Thereto, a mixture of 40 parts of vinyl monomer for copolymerization (styrene) and 2.0 parts by mass of benzoyl peroxide as a polymerization initiator was dropwise added from a dropping funnel over 4 hours. Then, the resulting mixture was allowed to react at 160° C. for 5 hours and then heated to 230° C., and 0.2% by mass of dibutyltin oxide was added thereto.

The resultant was removed from the container after completion of the reaction, cooled and pulverized to obtain a hybrid resin 1. The hybrid resin 1 had a Tg of 61° C. and a softening point of 130° C.

<Production Example of Hybrid Resin 2>

| | |
|---|---|
| Bisphenol A-ethylene oxide adduct (2.2 mol addition) | 100.0 parts |
| Terephthalic acid | 60.0 parts |
| Trimellitic anhydride | 20.0 parts |
| Acrylic acid | 10.0 parts |

Sixty parts of the above mixture is charged into a four-necked flask, which is equipped with a pressure decreasing apparatus, a water separation apparatus, a nitrogen gas introducing apparatus, a temperature measuring apparatus and a stirring apparatus, and then the mixture is stirred at 160° C. in a nitrogen atmosphere. Thereto, a mixture of 40 parts of vinyl monomer for copolymerization (styrene) and 2.0 parts by mass of benzoyl peroxide as a polymerization initiator was dropwise added from a dropping funnel over 4 hours. Then, the resulting mixture was allowed to react at 160° C. for 4 hours and then heated to 230° C., and 0.2% by mass of dibutyltin oxide was added thereto.

The resultant was removed from the container after completion of the reaction, cooled and pulverized to obtain a hybrid resin 2. The hybrid resin 2 had a Tg of 61° C. and a softening point of 129° C.

<Production Example of Vinyl Resin 1>

| | |
|---|---|
| Styrene | 70 parts by mass |
| n-Butyl acrylate | 24 parts by mass |
| Monobutyl maleate | 6 parts by mass |
| Benzoyl peroxide | 2 parts by mass |

Air in a four-necked flask was sufficiently replaced by nitrogen while 200 parts by mass of xylene was stirred in the four-necked flask. The xylene in the flask was heated to 120° C., and each of the above components was then dropwise added to the inside of the four-necked flask over 3.5 hours. Further, the polymerization was completed under xylene reflux, and the solvent was removed by distillation under reduced pressure to obtain a vinyl resin 1. The vinyl resin 1 had a Tg of 60° C. and a softening point of 129° C.

<Production Example of Polyester Resin 1>

| | |
|---|---|
| Bisphenol A-propylene oxide adduct (2.2 mol addition) | 60.0 parts |
| Bisphenol A-ethylene oxide adduct (2.2 mol addition) | 40.0 parts |
| Terephthalic acid | 77.0 parts |

The above polyester monomer mixture was charged into a 5-liter autoclave together with dibutyltin oxide in an amount of 0.2% by mass based on the total amount of the monomers. The autoclave was equipped with a reflux condenser, a water separation apparatus, an $N_2$ gas introducing pipe, a thermometer and a stirring apparatus, and the mixture was subjected to polycondensation reaction at 230° C. while introducing $N_2$ gas into the autoclave. The reaction time was adjusted so that a desired softening point might be obtained, and the resultant was removed from the autoclave after completion of the reaction, cooled and pulverized to obtain a polyester resin 1. The polyester resin 1 had a Tg of 59° C. and a softening point of 131° C.

<Production Example of Polyester Resin 2>

| | |
|---|---|
| Bisphenol A-propylene oxide adduct (2.2 mol addition) | 60.0 parts |
| Bisphenol A-ethylene oxide adduct (2.2 mol addition) | 40.0 parts |
| Terephthalic acid | 77.0 parts |

The above polyester monomer mixture was charged into a 5-liter autoclave. The autoclave was equipped with a reflux condenser, a water separation apparatus, an $N_2$ gas introducing pipe, a thermometer and a stirring apparatus, and the mixture was subjected to polycondensation reaction at 230° C. while introducing $N_2$ gas into the autoclave. The reaction time was adjusted so that a desired softening point might be obtained, and the resultant was removed from the autoclave after completion of the reaction, cooled and pulverized to obtain a polyester resin 2. The polyester resin 2 had a Tg of 60° C. and a softening point of 130° C.

<Production Example of Crystalline Polyester Resin 1>

| | |
|---|---|
| 1,12-Dodecanediol | 100.0 parts |
| Sebacic acid | 100.0 parts |

The above raw materials and dibutyltin oxide in an amount of 0.2% by mass based on the total amount of the monomers were charged into a 10-L four-necked flask equipped with a nitrogen introducing tube, a dewatering pipe, a stirring apparatus and a thermocouple, and then allowed to react at 180° C. for 4 hours. The reaction mixture was then heated to 210° C. at 10° C./1 hour, held at 210° C. for 8 hours, and allowed to react at 8.3 kPa for 1 hour to obtain a crystalline polyester resin 1. The resulting crystalline polyester resin had a melting point of 82.0° C.

<Production Example of Toner Matrix Particles 1>

| | |
|---|---|
| Hybrid resin 1 | 60.0 parts |
| Polyester resin 1 | 40.0 parts |
| Crystalline polyester resin 1 | 2.5 parts |
| Spherical magnetic iron oxide particles (number average particle size = 0.20 μm, Hc = 11.5 kA/m, σs = 88 $Am^2/kg$, σr = 14 $Am^2/kg$) | 60.0 parts |
| Releasing agent (Fischer-Tropsch Wax (C105, melting point: 105° C., manufactured by Sasol Corp.) | 2.0 parts |
| Charge control agent (T-77: manufactured by Hodogaya Chemical Co., Ltd.) | 2.0 parts |

The above materials were first mixed in a Henschel mixer and then melt-kneaded in a twin-screw kneading extruder.

The resulting kneaded product was cooled, subjected to coarse pulverization with a hammer mill, and then pulverized with a mechanical pulverization machine (T-250 manufactured by Turbo Kogyo Co., Ltd.). The resulting finely pulverized powder was classified with a multi-fraction classifier utilizing Coanda effect to obtain negatively charged raw material toner particles having a weight average particle size (D4) of 7.0 μm.

The raw material toner particles were subjected to surface modification with a surface modification apparatus Faculty (manufactured by Hosokawa Micron Corp.). In the modification, the rotary peripheral speed of the dispersing rotor was set to 150 m/sec; the amount of the charged finely pulverized product was set to 7.6 kg per 1 cycle; and the surface modification time (=cycle time, time from the completion of raw material feeding to the opening of the exhaust valve) was set to 82 sec. The temperature during the discharge of toner matrix particles was 44° C. Toner matrix particles 1 were obtained through the above steps.

<Production Example of Toner Matrix Particles 2>

Toner matrix particles 2 were obtained in the same manner as in the toner matrix particles 1 except that the hybrid resin 2 was used instead of the hybrid resin 1.

<Production Example of Toner Matrix Particles 3>

Toner matrix particles 3 were obtained in the same manner as in the toner matrix particles 1 except that the vinyl resin 1 was used instead of the hybrid resin 1.

<Production Example of Toner Matrix Particles 4>

Toner matrix particles 4 were obtained in the same manner as in the toner matrix particles 1 except that the polyester resin 2 was used instead of the hybrid resin 1.

<Production Example of Toner Matrix Particles 5>

Toner matrix particles 5 were obtained in the same manner as in the toner matrix particles 1 except that the releasing agent was changed to FNP90 (hydrocarbon wax, melting point: 91° C., Nippon Seiro Co., Ltd.).

<Production Example of Toner Matrix Particles 6>

Toner matrix particles 6 were obtained in the same manner as in the toner matrix particles 1 except that the releasing agent was changed to VISCOL 660P (polypropylene wax, melting point: 145° C., manufactured by Sanyo Chemical Industries, Ltd.) and the hybrid resin 1 was changed to the vinyl resin 1.

<Production Examples of Organic-Inorganic Composite Fine Particles 1 to 5, 7 and 8>

The organic-inorganic composite fine particles can be produced according to the description of Examples of WO2013/063291.

Organic-inorganic composite fine particles produced according to Example 1 of WO 2013/063291 using the silica shown in Table 1 were prepared as the organic-inorganic composite fine particles for use in Examples to be described below. The physical properties of the organic-inorganic composite fine particles 1 to 5, 7, and 8 are shown in Table 1.

In the measurement of differential scanning calorimetry (DSC), the organic-inorganic composite fine particles 1 to 5, 7 and 8 did not have an exothermic peak, an endothermic peak and a glass transition point (Tg) in the range from 20° C. to 220° C.

<Production Example of Organic-Inorganic Composite Fine Particles 6>

Organic-inorganic composite fine particles produced according to Comparative Example 1 of WO 2013/063291 using the silica shown in Table 1 were prepared as the organic-inorganic composite fine particles 6. The physical properties of the organic-inorganic composite fine particles 6 are shown in Table 1. The organic-inorganic composite fine particles 6 did not have an exothermic peak and an endothermic peak, but had Tg at 55° C.

in Table 1. In the measurement of differential scanning calorimetry (DSC), the organic-inorganic composite fine particles 9 did not have an exothermic peak, an endothermic peak and a glass transition point (Tg) in the range from 20° C. to 220° C.

<Production Example of Silica-adhered Resin Fine Particles 10>

A Henschel mixer was used to mix 100 parts by mass of polystyrene particles having a number average particle size of 100 nm and 4 parts by mass of colloidal silica having a number average particle size of 25 nm to obtain a silica-adhered resin fine particles 10 in which silica adhered to the resin particles. The physical properties of the organic-inorganic composite fine particles 10 are shown in Table 1. In the measurement of differential scanning calorimetry (DSC), the organic-inorganic composite fine particles 10 had a Tg of 100° C. and did not have an exothermic peak and an endothermic peak in the range from 20° C. to 220° C.

<Production Example of Organic-Inorganic Composite Fine Particles 11>

Organic-inorganic composite fine particles produced according to Example 10 of Japanese Patent No. 4321272 using the silica shown in Table 1 were prepared as the organic-inorganic composite fine particles 11. The physical properties of the organic-inorganic composite fine particles 11 are shown in Table 1. In the measurement of differential scanning calorimetry (DSC), the organic-inorganic composite fine particles 11 had a Tg of 80° C. and did not have an exothermic peak and an endothermic peak in the range from 20° C. to 220° C.

TABLE 1

| | Inorganic fine particles in organic-inorganic composite fine particles | | Organic-inorganic composite fine particles | | | | |
|---|---|---|---|---|---|---|---|
| | Type | Particle size [nm] | Content of inorganic fine particles [% by mass] | Number average particle size [nm] | SF-1 | SF-2 | THF-insoluble matter in resin [%] |
| Organic-inorganic composite fine particles 1 | Colloidal silica | 25 | 67% | 106 | 122 | 115 | 99 |
| Organic-inorganic composite fine particles 2 | Colloidal silica | 25 | 49% | 130 | 135 | 117 | 99 |
| Organic-inorganic composite fine particles 3 | Colloidal silica | 15 | 46% | 99 | 110 | 103 | 98 |
| Organic-inorganic composite fine particles 4 | Colloidal silica | 25 | 28% | 335 | 122 | 106 | 99 |
| Organic-inorganic composite fine particles 5 | Colloidal silica | 20 | 68% | 71 | 105 | 108 | 99 |
| Organic-inorganic composite fine particles 6 | Colloidal silica | 25 | 30% | 150 | 105 | 110 | 30 |
| Organic-inorganic composite fine particles 7 | Colloidal silica | 50 | 33% | 210 | 120 | 120 | 98 |
| Organic-inorganic composite fine particles 8 | Colloidal silica | 15 | 64% | 62 | 105 | 104 | 99 |
| Organic-inorganic composite fine particles 9 | Colloidal silica | 7.9 | 11% | 270 | 105 | 110 | 99 |
| Organic-inorganic composite fine particles 10 | Colloidal silica | 15 | 4% | 100 | — | — | 99 |
| Organic-inorganic composite fine particles 11 | Colloidal silica | 25 | 50% | 190 | 130 | 108 | 75 |

<Production Example of Organic-Inorganic Composite Fine Particles 9>

Organic-inorganic composite fine particles produced according to Example 1 of Japanese Patent No. 4321272 using the silica shown in Table 1 were prepared as the organic-inorganic composite fine particles 9. The physical properties of the organic-inorganic composite fine particles 9 are shown <Other Additives>

The physical properties of inorganic fine particles 1 and organic fine particles 1 are shown in Table 2 as the additives used in addition to the above organic-inorganic composite fine particles in the Production Examples of toner to be described below. EPOSTAR S6 manufactured by Nippon Shokubai Co., Ltd. was used as the organic fine particles.

TABLE 2

| | Number average particle size [nm] | SF-1 | SF-2 | THF-insoluble matter in resin [%] |
|---|---|---|---|---|
| Inorganic fine particles 1 (colloidal silica) | 100 | 100 | 100 | — |
| Organic fine particles 1 | 300 | 100 | 100 | 99 |

<Production Example of Magnetic Toner 1>

To 100.0 parts of toner matrix particles, 1.1 parts of the organic-inorganic composite fine particles 1 and 0.5 parts of a hydrophobic silica fine powder whose surface is treated with hexamethyldisilazane (the number average particle size of primary particles: 10 nm) were added, and the resultant was mixed in a Henschel mixer for 2 minutes at 3200 rpm to obtain a magnetic toner 1. The SP values of the used releasing agents and the resin components in the organic-inorganic composite fine particles are shown in Table 3.

<Production Example of Magnetic Toners 2 to 17>

Magnetic toners 2 to 17 were obtained in the same manner as in the magnetic toner 1 except that the type of the toner matrix particles and external additives having a large particle size to be used was changed as shown in Table 3. The SP values of the used releasing agents and the resin components in the organic-inorganic composite fine particles are shown in Table 3.

Example 1

The magnetic toner 1 was evaluated as follows. The evaluation results are shown in Table 4.

[Evaluation of Durable Performance of Toner]

An HP LaserJet Enterprise600 M603dn (manufactured by HP Company) was used by modifying the original process speed to a higher speed of 400 mm/s.

Two predetermined process cartridges each filled with 982 g of the magnetic toner 1 were prepared. A mode of printing was set as follows: a horizontal line pattern having a printing rate of 5% was printed on a sheet; printing of two sheets was defined as one job; and the machine once stops between the jobs before starting the next job. An image output test was performed on the same printer in which 35000 sheets were printed by one cartridge, and 70000 sheets in total were printed per by cartridges. The image density was measured at the 35000th sheet and the 70000th sheet, and the presence or absence of the occurrence of contamination on the pressure roller was checked at the same time. The evaluation was performed in a high-temperature, high-humidity environment (32.5° C., 85% RH) which is a severe condition that softens the binder resin of toner matrix particles and accelerates the embedding of external additives.

The image density was determined by measuring the reflection density of a solid black image of a 5-mm circle through an SPI filter with a Macbeth densitometer (manufactured by Macbeth Co. Ltd.) which is a reflection densitometer.

TABLE 3

| | Matrix | Type of external additives having a large particle size | Properties of external additives having a large particle size: Number average particle size [nm] | SF-1 | SF-2 | Melting point of releasing agent [° C.] | SP value of releasing agent [(cal/cm$^3$)$^{1/2}$] | SP value of resin component in organic-inorganic composite fine particles [(cal/cm$^3$)$^{1/2}$] | Absolute value of the difference of SP values [(cal/cm$^3$)$^{1/2}$] |
|---|---|---|---|---|---|---|---|---|---|
| Magnetic toner 1 | Magnetic toner particles 1 | Organic-inorganic composite fine particles 1 | 106 | 121 | 115 | 105 | 8.55 | 9.04 | 0.49 |
| Magnetic toner 2 | Magnetic toner particles 1 | Organic-inorganic composite fine particles 2 | 130 | 135 | 118 | 105 | 8.55 | 9.04 | 0.49 |
| Magnetic toner 3 | Magnetic toner particles 1 | Organic-inorganic composite fine particles 3 | 99 | 110 | 103 | 105 | 8.55 | 9.04 | 0.49 |
| Magnetic toner 4 | Magnetic toner particles 2 | Organic-inorganic composite fine particles 1 | 107 | 123 | 116 | 105 | 8.55 | 9.04 | 0.49 |
| Magnetic toner 5 | Magnetic toner particles 3 | Organic-inorganic composite fine particles 1 | 105 | 122 | 115 | 105 | 8.55 | 9.04 | 0.49 |
| Magnetic toner 6 | Magnetic toner particles 4 | Organic-inorganic composite fine particles 1 | 106 | 122 | 116 | 105 | 8.55 | 9.04 | 0.49 |
| Magnetic toner 7 | Magnetic toner particles 5 | Organic-inorganic composite fine particles 1 | 106 | 122 | 115 | 91 | 8.54 | 9.04 | 0.50 |
| Magnetic toner 8 | Magnetic toner particles 1 | Organic-inorganic composite fine particles 4 | 335 | 123 | 105 | 105 | 8.55 | 9.04 | 0.49 |
| Magnetic toner 9 | Magnetic toner particles 1 | Organic-inorganic composite fine particles 5 | 71 | 106 | 107 | 105 | 8.55 | 9.04 | 0.49 |
| Magnetic toner 10 | Magnetic toner particles 1 | Organic-inorganic composite fine particles 7 | 210 | 120 | 121 | 105 | 8.55 | 9.04 | 0.49 |
| Magnetic toner 11 | Magnetic toner particles 6 | Organic-inorganic composite fine particles 6 | 151 | 104 | 112 | 145 | 7.28 | 9.04 | 1.76 |
| Magnetic toner 12 | Magnetic toner particles 1 | Organic-inorganic composite fine particles 8 | 62 | 105 | 103 | 105 | 8.55 | 9.04 | 0.49 |
| Magnetic toner 13 | Magnetic toner particles 1 | Inorganic fine particles 1 | 102 | 101 | 101 | 105 | 8.55 | 17.80 | 9.25 |
| Magnetic toner 14 | Magnetic toner particles 1 | Organic fine particles 1 | 305 | 100 | 102 | 105 | 8.55 | 8.50 | 0.05 |
| Magnetic toner 15 | Magnetic toner particles 6 | Organic-inorganic composite fine particles 9 | 272 | 106 | 112 | 145 | 7.28 | 8.50 | 1.22 |
| Magnetic toner 16 | Magnetic toner particles 1 | Organic-inorganic composite fine particles 10 | 101 | — | — | 105 | 8.55 | 9.09 | 0.54 |
| Magnetic toner 17 | Magnetic toner particles 1 | Organic-inorganic composite fine particles 11 | 192 | 130 | 108 | 105 | 8.55 | 9.04 | 0.49 |

It is indicated that the larger the numerical value is, the better the developability is. Specific evaluation criteria are shown below.

A: 1.45 or more

B: 1.40 or more and less than 1.45

C: 1.35 or more and less than 1.40

D: Less than 1.35

[Evaluation of Contamination on Pressure Roller]

The degree of contamination on the pressure roller due to the accumulation of hot offset was visually evaluated. Evaluation criteria are shown below. Note that the contamination tends to occur from the drive side end because the drive side is mechanically highly loaded and easily heated. Next, the contamination tends to occur at the end on the opposite side, and the contamination occurs on the whole surface at the poorest level.

A: No contamination

B: Contamination occurs at the drive side end

C: Contamination occurs at both ends

D: Contamination occurs on the whole surface

[Evaluation of Low-Temperature Fixability]

The HP LaserJet Enterprise600 M603dn (manufactured by HP Company) was modified so that the fixing temperature of the fixing apparatus therein could be arbitrarily set.

Using this apparatus, the temperature of the fixing unit is controlled at an interval of 5° C. in a temperature range of 170° C. or more and 220° C. or less, and a halftone image is outputted on bond paper (basis weight: 75 g/m$^2$) so that image density may be from 0.60 to 0.65. The resulting image was reciprocatingly rubbed 5 times with Silbon paper under a load of 4.9 kPa, and the density reduction rate of the image density before and after rubbing was measured. The temperature at which the density reduction rate is 10% was calculated from the relation between the fixing temperature and the density reduction rate, and the low-temperature fixability was evaluated based on the following criteria. It is indicated that the lower the above temperature is, the better the low-temperature fixability is. The low-temperature fixability was evaluated in a low-temperature, low-humidity environment (7.5° C./15% RH).

A: The temperature at which the density reduction rate is 10% is less than 205° C.

B: The temperature at which the density reduction rate is 10% is 205° C. or more and less than 210° C.

C: The temperature at which the density reduction rate is 10% is 210° C. or more and less than 215° C.

D: The temperature at which the density reduction rate is 10% is 215° C. or more Examples 2 to 10 and Comparative Examples 1 to 7

The evaluation was performed in the same manner as in Example 1 except that the magnetic toners 2 to 17 were used. The evaluation results are shown in Table 4.

TABLE 4

| | | Pressure roller contamination | | Image density | | Low-temperature fixability |
|---|---|---|---|---|---|---|
| | Toner | 35000th sheet | 70000th sheet | 35000th sheet | 70000th sheet | [° C.] |
| Example 1 | Magnetic toner 1 | A | B | A (1.55) | A (1.42) | A (203) |
| Example 2 | Magnetic toner 2 | A | C | A (1.54) | A (1.40) | A (202) |
| Example 3 | Magnetic toner 3 | A | B | A (1.55) | B (1.39) | A (202) |
| Example 4 | Magnetic toner 4 | A | C | A (1.53) | A (1.50) | A (204) |
| Example 5 | Magnetic toner 5 | B | C | A (1.45) | A (1.45) | A (202) |
| Example 6 | Magnetic toner 6 | A | C | A (1.42) | A (1.42) | A (203) |
| Example 7 | Magnetic toner 7 | A | B | A (1.50) | A (1.41) | A (203) |
| Example 8 | Magnetic toner 8 | A | C | A (1.52) | B (1.36) | A (201) |
| Example 9 | Magnetic toner 9 | A | C | A (1.50) | B (1.37) | A (202) |
| Example 10 | Magnetic toner 10 | A | B | A (1.50) | A (1.40) | B (206) |
| Comparative Example 1 | Magnetic toner 11 | D | D | B (1.55) | D (1.29) | C (212) |
| Comparative Example 2 | Magnetic toner 12 | C | D | B (1.38) | D (1.29) | B (206) |
| Comparative Example 3 | Magnetic toner 13 | D | D | A (1.50) | A (1.42) | D (216) |
| Comparative Example 4 | Magnetic toner 14 | D | D | D (1.29) | D (1.28) | A (200) |
| Comparative Example 5 | Magnetic toner 15 | D | D | B (1.35) | D (1.22) | D (216) |
| Comparative Example 6 | Magnetic toner 16 | D | D | D (1.28) | D (1.25) | B (207) |
| Comparative Example 7 | Magnetic toner 17 | D | D | B (1.37) | D (1.28) | B (206) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-158914, filed Jul. 31, 2013, which is hereby incorporated by reference herein in its entirety.

What is claimed is:

1. A toner, comprising:

toner particles each containing a binder resin and a releasing agent; and an organic-inorganic composite fine particle, wherein:

the organic-inorganic composite fine particle comprises:

a vinyl resin particle containing a vinyl resin, the vinyl resin containing THF-insoluble matter in an amount of 95% by mass or more; and inorganic fine particles which are exposed at surfaces of the respective organic-inorganic composite fine particles, the organic-inorganic composite fine particle 1) has a plurality of convexes derived from the inorganic fine particles on the surfaces thereof, 2) has a number average particle size of 70 nm or more and 500 nm or less, and 3) has a shape factor SF-2 as measured at a magnification of 200,000 times of 103 or more and 120 or less; and wherein an absolute value of a difference between an SP value of the releasing agent and an SP value of the vinyl resin is 0.50 $(cal/cm^3)^{1/2}$ or less.

2. The toner according to claim 1, wherein the organic-inorganic composite fine particle has a shape factor SF-1 as measured at a magnification of 200,000 times of 110 or more and 140 or less.

* * * * *